United States Patent [19]

Foxwell

[11] 4,386,552

[45] Jun. 7, 1983

[54] POWER CYLINDER WITH INTERNALLY MOUNTED POSITION INDICATOR

[76] Inventor: W. John Foxwell, 2557 Lake Charnwood Blvd., Troy, Mich. 48098

[21] Appl. No.: 232,844

[22] Filed: Feb. 9, 1981

Related U.S. Application Data

[63] Continuation-in-part of Ser. No. 159,735, Jun. 16, 1980, abandoned.

[51] Int. Cl.[3] ..... F01B 25/26

[52] U.S. Cl. ..... 91/1; 91/363 R; 92/5 R

[58] Field of Search ..... 91/1, 361, 363 R, 363 A, 91/382; 92/5 R, 5 L

[56] References Cited

U.S. PATENT DOCUMENTS

| | | | |
|---|---|---|---|
| 3,135,164 | 6/1964 | Scotto | 92/5 R |
| 3,352,322 | 11/1967 | Strick | 91/1 |
| 3,403,365 | 9/1968 | Richards | 92/5 R |
| 3,720,118 | 3/1973 | McCormick | 91/363 R |
| 3,726,191 | 4/1973 | Johnston | 92/5 R |
| 3,797,364 | 3/1974 | Schulze | 91/382 |
| 3,905,720 | 9/1975 | Greune | 91/368 |
| 3,915,070 | 10/1975 | Mailliet | 92/33 |
| 3,977,300 | 8/1976 | Sherman | 91/382 |
| 4,121,504 | 10/1978 | Nowak | 92/5 R |
| 4,179,982 | 12/1979 | Saotome | 92/5 R |

FOREIGN PATENT DOCUMENTS

| | | | |
|---|---|---|---|
| 5478 | 5/1979 | European Pat. Off. | 92/5 R |
| 2216467 | 8/1974 | France . | |
| 1130604 | 10/1968 | United Kingdom . | |
| 1369673 | 10/1974 | United Kingdom . | |
| 1526211 | 9/1978 | United Kingdom . | |

*Primary Examiner*—Abraham Hershkovitz
*Attorney, Agent, or Firm*—John R. Benefiel

[57] ABSTRACT

A fluid pressure actuator is disclosed of the piston and cylinder type, in which an internally mounted transducer is incorporated for providing an electrical output signal corresponding to the position of the piston in the cylinder. The transducer is disclosed as a rotary potentiometer having a disc or drum element provided with conductive plastic tracks and a rotary wiper element rotated in correspondence with the linear travel of the piston in the cylinder by a connected cam rod slidably mounted within the piston rod and caused to rotate in one embodiment by means of a cam bushing engaging the cam rod, and in other embodiments by three converging spring biased plungers carried in the piston engaging respective sides of a hexagonal shaped cam rod. Other disclosed arrangements include a reduction drive interposed between the cam element and the rotary wiper to enable a multiturn cam element to be employed with a single turn potentiometer disc, and a multi-turn drum potentiometer having a wiper element driven by the cam rod engaging a helical thread form to be axially advanced by the piston motion.

17 Claims, 12 Drawing Figures

POWER CYLINDER WITH INTERNALLY MOUNTED POSITION INDICATOR

CROSS REFERENCE TO RELATED APPLICATIONS

This is a continuation-in-part of Ser. No. 159,735 filed June 16, 1980 now abandoned.

BACKGROUND DISCUSSION

It is often desirable or necessary to provide a position feedback signal for an actuator device which is utilized to produce motion or positioning of a component of a machine or other equipment. Such instances occur in the design of industrial equipment and such machinery as earth moving and farm equipment for the control of implements such as backhoes, buckets, bulldozer blades, plow blades, etc.

Such feedback signals are desirably electrical and are generated by an electrical transducer associated with the movable part or with the part actuator member, which causes positioning of a transducer element such as to create electrical output signals corresponding to the position of the movable part. These transducers have often taken the form of slidewire or potentiometer devices having either linear or rotary elements which are drivingly connected to the movable elements to provide this transducing function.

The actuator is typically comprised of a fluid pressure actuator and commonly takes the form of a pneumatic or hydraulic power cylinder with a piston reciprocated in a cylinder by the application of fluid pressure. The piston motion is transmitted to the controlled component via a suitable driving connection to cause the movement or positioning of the controlled part or component.

Often, the transducer is mounted in a relatively vulnerable position and is of relatively fragile construction such as to be subject to malfunction due to mechanical abuse and/or environmental conditions such as the presence of dust, dirt or other contaminants.

This is particularly a problem in application to earth moving and farm equipment.

There have been a number of prior attempts to provide a direct association of the transducer with the fluid actuator in order to have a self-contained fluid actuator feedback transducer. Typical of these approaches are those disclosed in U.S. Pat. Nos. 3,915,070 to Mailliet; 4,121,504 to Nowak; 4,179,982 to Saotome and German Pat. No. 2,339,324 to Jurgen Lohse. In these prior art approaches, either a linear or rotary motion is imparted to a detector element, associated with the piston and cylinder to produce a corresponding output motion. This element is coupled to a transducer to produce an electrical output signal.

However, in these instances, the transducer is mounted externally of the cylinder and also is driven with relatively elaborate driving connections between the movable element and the transducer such that the resultant combination is relatively costly, severely limiting the application of such devices and also remains vulnerable precluding use for the heavy service applications described.

In U.S. Pat. No. 3,403,365 to Richards, there is disclosed an attempt to protect the transducer by a more or less internal mounting of the transducer components. However, this arrangement requires the entire transducing assembly to be mounted within the interior of the piston rod, rendering such approach impractical for any but large size cylinders. Additionally, the particular mechanism is relatively complex and costly to manufacture.

Accordingly, it is an object of the present invention to provide an indicator arrangement for fluid pressure actuators of the piston and cylinder type which is readily adaptable for cylinders of all sizes.

It is yet another object of the present invention to provide such position indicator apparatus which is completely enclosed so as to be protected enabling use of such cylinders in rugged environments such as in agricultural and earth moving equipment.

It is still another object of the present invention to provide such position indicator for fluid pressure actuators which is extremely simple in configuration such as to be enabled to be provided at extremely low cost allowing such cylinders to be utilized in a great variety of applications.

SUMMARY OF THE INVENTION

These and other objects of the present invention, which will become apparent upon a reading of the following specification and claims, are achieved by an internally mounted rotary potentiometer which is mounted within an end cap of the cylinder in general alignment with the cylinder axis. A cam actuator rod is slidably mounted within a bore formed in the cylinder rod and also is engaged by at least one cam element, which in one embodiment consists of a cam bushing, the cam actuator rod and bushing being configured such that upon relative axial movement between the piston rod and cam element carried by the piston and rod assembly, rotation of the cam occurs.

In other embodiments, the cam elements consist of a plurality, i.e., three converging spring biased plungers carried by the piston, engaging respective flat sides of the cam rod.

The cam rod is axially restrained so as to be rotated by stroking movement of the piston by means of components included in the rotary potentiometer.

The potentiometer includes a wiper component adapted to be rotated by the cam rod rotation by a coupling element affixed to the end of the cam rod. The potentiometer also includes a conductive track carrying element such as a disc or drum of a conductive plastic construction to be adapted to high pressure applications and resistant to hydraulic fluids so as to be able to function reliably in an internal location within the piston and cylinder.

The transverse area of the cam rod is compact, to be capable of being fitted within all but the thinnest piston rod sizes, such that the arrangement is adaptable to cylinder sizes of a wide range. The rotary potentiometer, cam rod and related elements are very simple in construction and enable the indicator function to be added to cylinders without substantial cost penalty such as to create a wide variety of potential application for such position indicating cylinders.

In alternate embodiments, there is provided connections between the potentiometer wiper element and the cam rod such as to enable multiple turns of the cam rod during cylinder stroking to accommodate a single turn potentiometer disc.

Alternatively, multiple turn potentiometers are mounted within the end cap cavity.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

That is, for purposes of describing an example of the position indicator according to the present invention, specific embodiments will be described, but it is to be understood that the invention has application to all of the various configurations of piston and cylinder fluid pressure actuators, the various alternate constructions of such cylinders and mounting arrangements such as clevis, flange or trunnion mounted.

Figure 1:
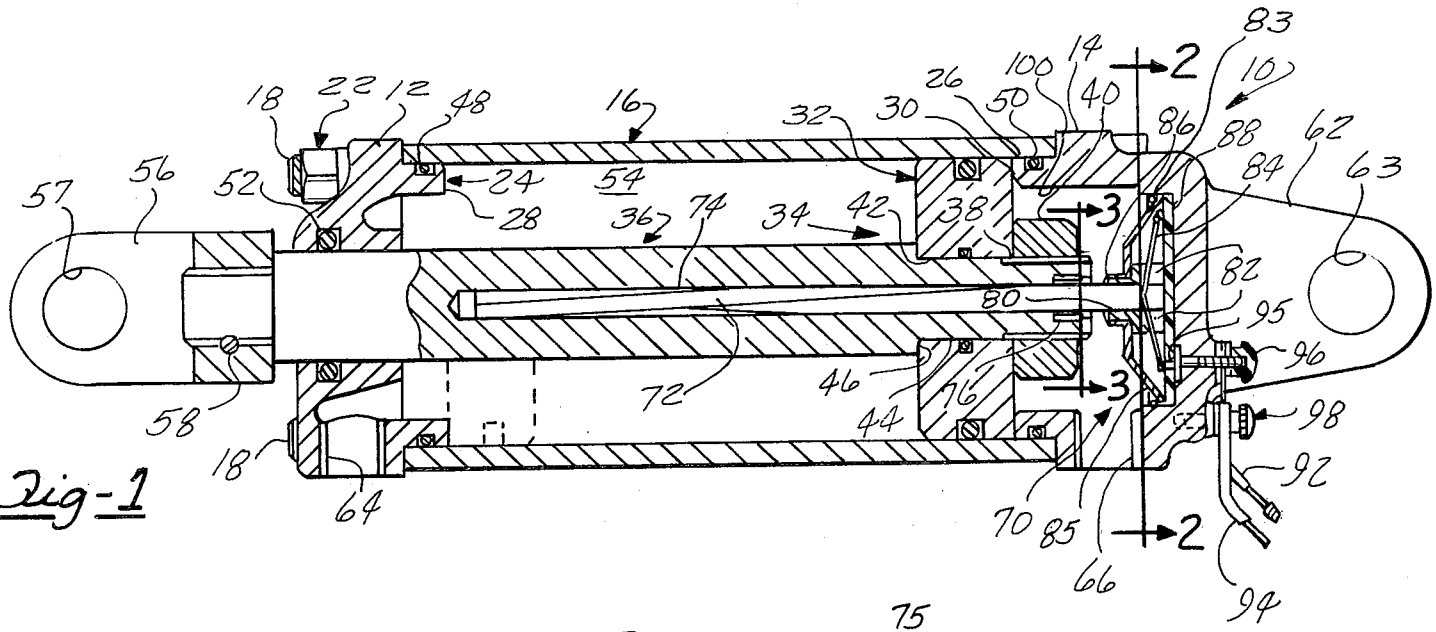
FIG. 1 is a view of a fluid pressure actuator cylinder in partial lengthwise section provided with an indicator arrangement according to the present invention.
Figure 2:
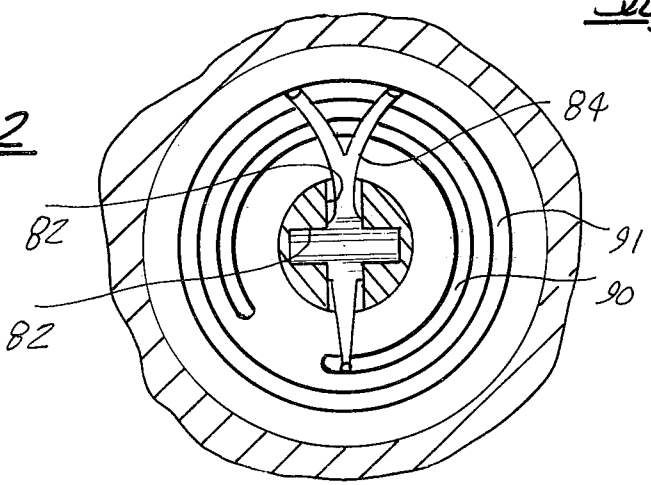
FIG. 2 is an endwise view taken through the lines 2—2 of FIG. 1.

Accordingly, FIG. 1 depicts a fluid pressure actuator 10 of the clevis mounted type and in which a pair of end caps 12 and 14 is provided with boss portions 24 and 26, respectively, received within the inside diameter of the cylinder sleeve 16 serving to pilot the same therein.

The end faces 28 and 30 of each of the end caps comprise abutments engaged by the piston 32 in the respective extreme positions of the piston 32 to provide positive stops for a piston 32 slidably mounted within the inside diameter of the cylinder sleeve 16. The piston 32 is a component of a piston assembly generally indicated at 34, consisting of the piston 32 and a piston rod 36. Piston 32 is mounted on piston rod 36 by means of a threaded end section 38 and a threaded nut element 40. For this purpose, the piston 32 is formed with an interior bore 42 slidably received over a reduced diameter section 44 of the piston rod 36. The piston 32 is positioned against the shoulder 46 formed between the main section of piston rod 36 and reduced diameter section 44, and also by the threaded nut element 40 advanced on the threaded end section 38.

The end caps 12 and 14 are provided with suitable seals 48 and 50 received in corresponding seal grooves. The piston rod 36 extends out through end cap 12 and mates with O-ring seal 52 provided in a recess in end cap 12 such as to provide a fluid tight sealing of the interior of the space generally indicated at 54 within the cylinder sleeve 16 and intermediate end caps 12 and 14.

The piston rod 36 is provided with a clevis element 56 keyed at 58 to a stub portion 60 of the piston rod 36, while end cap 14 is adapted to provide a clevis mounting by means of an integral clevis 62 formed thereon. The respective bores 57 and 63 are adapted to receive mounting pins for securing the cylinder to the supporting structure and/or the part to be actuated.

Suitable pressure ports 64 and 66 are provided in end caps 12 and 14, respectively, to enable communication with a fluid pressure supply system to the interior space 54 on either side of the piston 32. Suitable hydraulic controls (not shown) enable fluid to be supplied under pressure to one or the other of the inlet ports 64 or 66 such that the piston and rod assembly 34 may be stroked within the cylinder sleeve 16 to produce cylinder actuation in well known fashion.

The indicator arrangement according to the present invention consists of a completely internally mounted rotary potentiometer generally indicated at 70. The potentiometer is operated by means of a cam rod 72 extending into a receiving bore 74 formed axially into the piston rod 36 from the opposite direction of end cap 12 for a distance such as to be able to accommodate the full length of the cam rod 72 with an easy sliding fit therebetween.

Figure 3:
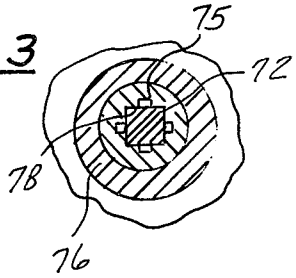
FIG. 3 is a view of the section 3—3 taken in FIG. 1.
Figure 4:
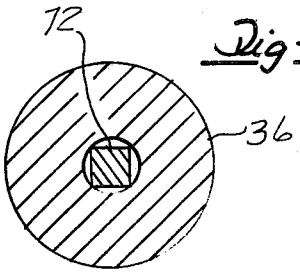
FIG. 4 is a view of the section 4—4 taken in FIG. 1.

The cam rod 72 is spirally wound and square in cross section as shown in FIG. 3 and is engaged with at least one cam element, in this embodiment received in a bore or opening 78 formed in a cam bushing element 76 which in turn is mounted in a counterbore extending into the end face of the piston 32, and which is press fitted so as to be rotatably fixed with respect to the piston rod 36. The opening 78 is square formed to be complementary to the cam rod 72 to prevent relative rotation and sized to just slidably receive the cam rod 72 with vent openings 75 enabling free bypass of hydraulic fluid during stroking. Alternate cam rod and bushing bore cross sectional shapes may of course be employed.

Cam rod 72 has a projecting end section attached to a wiper coupling member 80, which is formed with cross slots 82 adapted to receive a potentiometer wiper contact element 84. The wiper contact element 84 thus rotates together with the wiper coupling member 80 and the cam rod 72.

A potentiometer cover disc 85 is provided with an opening 86 providing rotatable support for the coupling member 80. The rotary potentiometer 70 also includes a track element here comprised of a plastic disc 88 on which is provided wiper tracks 90 and 91 comprised of a layer of conductive plastic bonded to the track disc 88. Such discs are of conventional construction utilized in commercially available rotary potentiometers.

Potentiometer cover disc 85 and plastic track disc 88 are retained against the endwall with a suitably shaped retainer 83. Such discs resist high pressures and contact with hydraulic fluids and accordingly are well suited to the internally mounted actuator application described herein.

Suitable external connections are provided comprised of ground wire 92 and lead 94. The lead 94 is provided with an electrical connection to the wiper track 90 via conductor 95 and terminal screw 96. The ground wire 92 is connected via terminal 98 to the end cap itself which provides a ground by contact with the inside face of the conductive plastic track 91.

The electrical resistance accordingly varies between the leads 92 and 94 with the rotational position of the wiper contact element 84 and connected cam rod 72. The cam rod 72 in turn is rotatably positioned in correspondence with the axial position of the piston and rod assembly 34 with the space 54.

It can be appreciated that the rotary potentiometer 70 itself is extremely simple and compact in construction and able to be interfit within the cavity 100 of the end cap 14. The cam rod 72 can be of relatively slender dimensions such that piston rods 36 of all but the smallest diameter may accommodate the same.

The rotary potentiometer 70 is of a single turn type, i.e., 360° or less rotation for a full stroking of the piston and rod assembly 34. The twist in the cam rod 72 thus provides approximately one turn thereof upon full length stroking of the piston and rod assembly 34.

In some instances, it may be desirable to provide a multiple twist cam rod 72 necessitating a multiple turn rotary potentiometer. Instead of utilizing a multiple turn potentiometer, alternative drive arrangements for producing driving connection between the cam rods 72 and the potentiometer wiper contact elements 84 may be desirable. Suitable alternative drive arrangements are shown in FIGS. 5 and 6.

Figure 5:
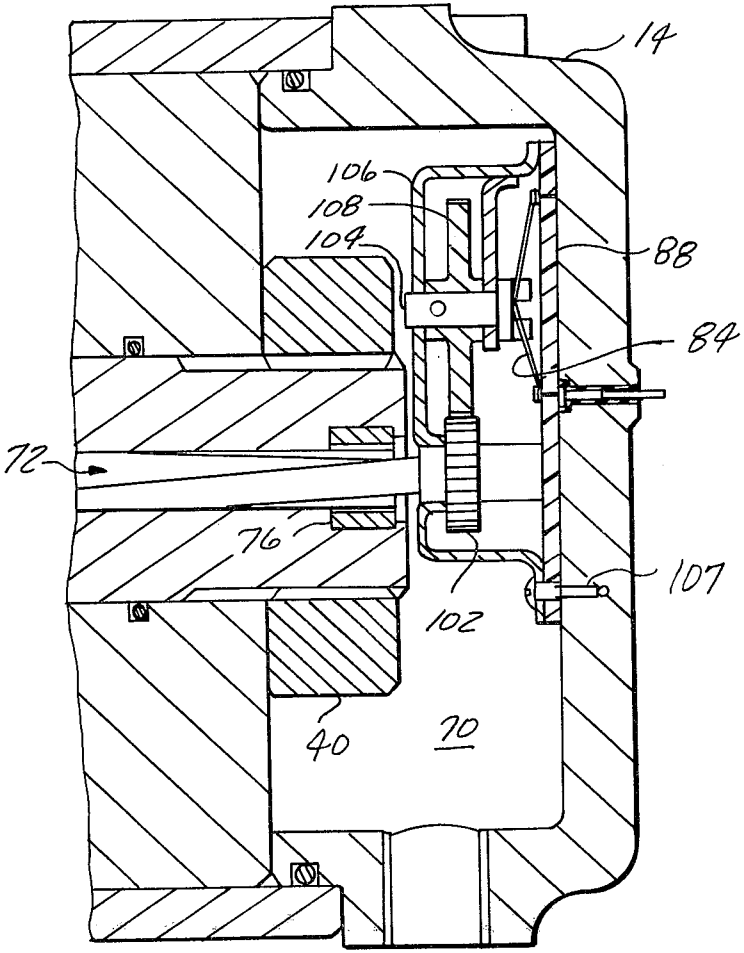
FIG. 5 is a fragmentary view of the fluid pressure actuator in partial longitudinal section depicting an alternative potentiometer drive arrangement particularly adapted to relatively long stroke, large diameter cylinders.
Figure 6:
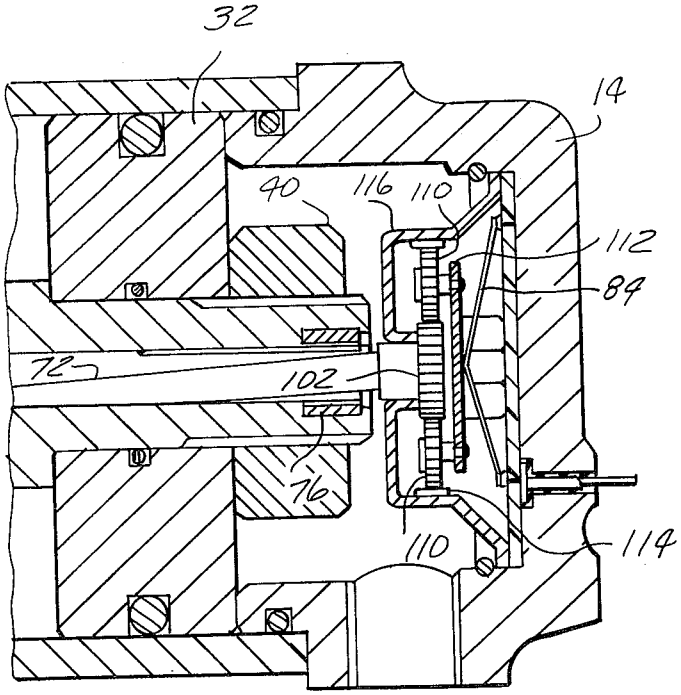
FIG. 6 is a longitudinal sectional view of an end portion of a fluid pressure actuator showing an alternative drive arrangement for the rotary potentiometer particularly adapted to relatively long stroke, small diameter cylinders.

In the embodiment of FIG. 5, the cam rod 72 has affixed thereto a spur gear 102. In this case, a separate wiper shaft 104 is provided supported on a potentiometer housing 106 secured with screws 107, to which wiper shaft 104 is affixed a larger diameter spur gear 108 in mesh with spur gear 102 to provide a reduction.

The wiper contact element 84 is secured to the wiper shaft 104 and conductive plastic track disc 88 employed as in the above-described embodiment. Accordingly, a reduced drive may be achieved such that a multi-turn cam rod 72 may be employed which results in less than 360° rotation of the wiper contact element 84. This arrangement inherently requires an off-axis location of the rotary potentiometer 70 necessitating relatively large diameter cylinders to accommodate the same. The embodiment shown in FIG. 6 is adaptable to smaller diameter cylinders. In this case, an on-axis planetary gearing is employed consisting of planetary gears 110 rotatably supported on a carrier 112 in mesh with the spur gear 102 acting as a sun gear with the planetary gears 110 also in mesh with a ring gear 114 supported in housing 116 and fixed to end cap 14, thus providing a gear reduction to the wiper contact element 84.

Referring to FIGS. 7–10, an alternative arrangement is disclosed for engaging the cam rod element to produce the relative rotation upon stroking of the piston and rod assembly within the cylinder.

In this arrangement a plurality of camming elements are provided, each consisting of a plunger 120 slidably mounted in corresponding bores 122 extending out radially through the piston 20 and the reduced threaded section 38 of the piston rod 36. Each of the plungers 120 is provided with a small vent passage 124 enabling the venting for pressure equalization of the hydraulic pressure existing within the cylinder in order to preclude the generation of any significant hydraulic forces tending to unload the plungers 120. Each of the plungers 120 is spring biased to converge radially by means of a compression spring 126 disposed in the bore 122. In order to maintain the spring compressed a plurality of corresponding respective balls 128 are provided, one each disposed in a respective bore 122 which is pressed fit into the bores and peened to be seated therein to maintain each of the springs confined and compressed within the bores 122.

Figure 9:
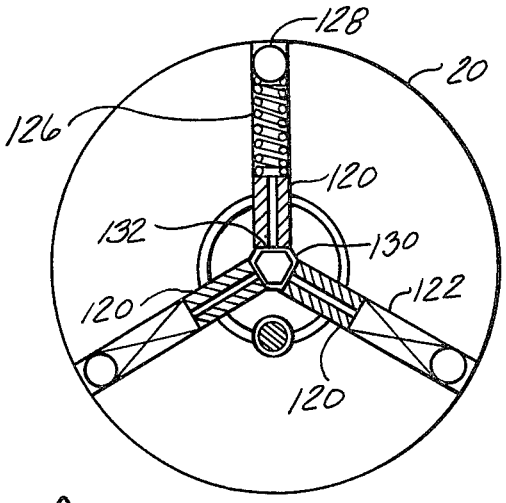
FIG. 9 is a view of the section 9—9 taken in FIG. 8.
Figure 10:
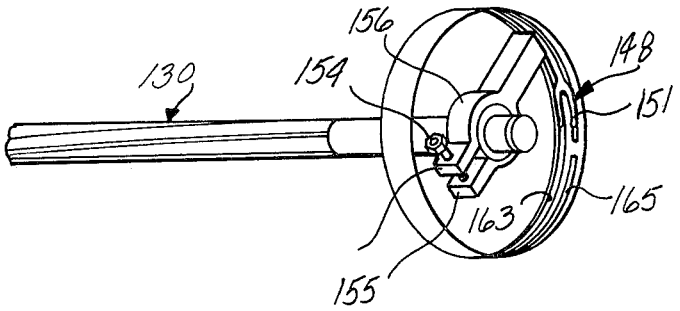
FIG. 10 is a perspective view of certain of the potentiometer components shown in FIGS. 7-9.

In this embodiment, the cam rod 130 is of hexagonal shape as best seen in FIG. 9 such as to provide a series of flat sides 132, engageable by the end faces of each plunger 120 in order to provide the camming engagement. Thus, the plungers 120, being fixed rotatably with respect to the piston 20, cause rotation of the cam rod 130 upon stroking thereof due to the interengagement, since relative rotation between the piston 20 and the cam rod 130 is precluded.

This design greatly eases the manufacturing problems inherent in providing proper concentricity and run out of the cam rod 130 with respect to the bore 134 which receives the cam rod lengthwise bore 134 extending into the piston rod 36 as well as the potentiometer components here indicated by the numeral 136. This results from the self-centering action created by the converging spring biased plungers 120, in engagement with the cam rod 130. The cam rod 130 is also provided with a turned end portion 138 which is slidably received in a bore 140 formed in the piston end cap 142 such as to insure concentricity of the cam rod with respect to the potentiometer components.

Figure 7:
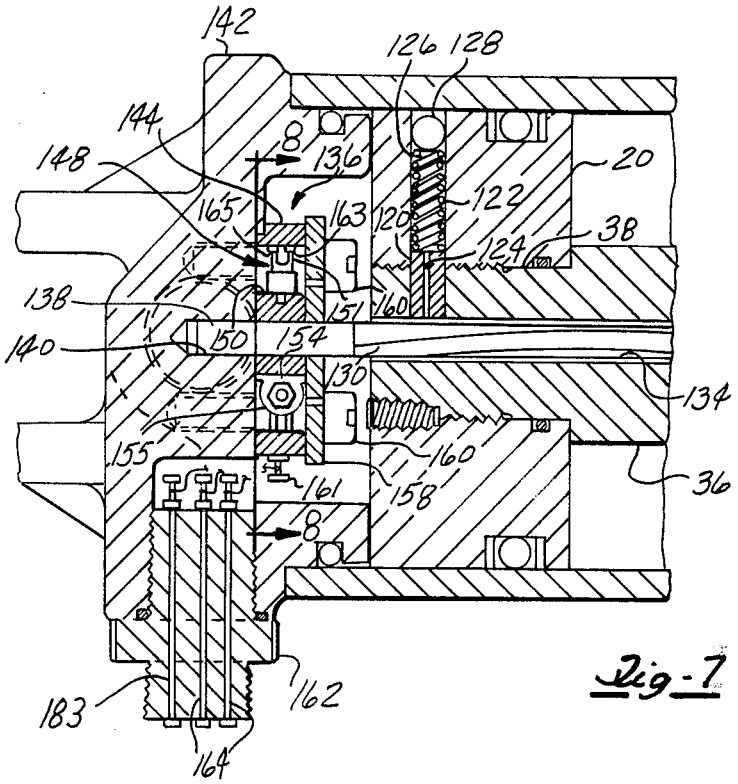
FIG. 7 is a fragmentary view of a fluid pressure actuator in partial longitudinal section incorporating alternate cam elements and potentiometer componentry.
Figure 8:
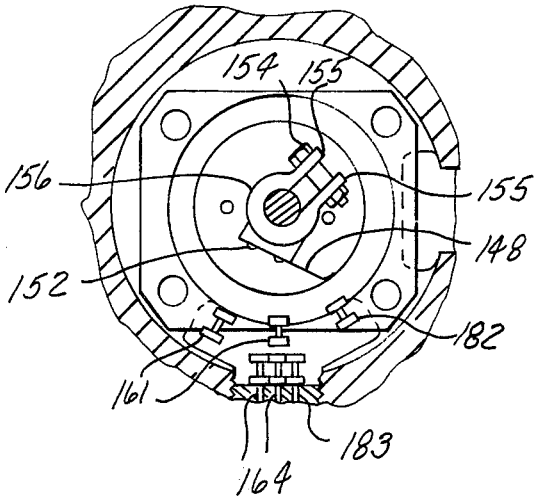
FIG. 8 is a fragmentary endwise view of the components shown in FIG. 7.

The potentiometer components are also different in the embodiment disclosed in FIG. 7 in that the potentiometer track element here takes the form of a drum 144 having an interior bore 146 which is engaged by a forked wiper element 148 having a pair of tines 151. Wiper element 148 is affixed to clamping collar 150 by screws 152. Collar 150 is secured to the cam rod end portion 138 by means of a tightening bolt 154 passing through tabs 155 clamping the clamping collar 150 tightly to the cam rod end portion 138. The entire assembly is secured by means of a retainer plate 158 secured by threaded screws 160 extending into the end wall of the end cap 142. This also secures the cam rod 130 against endwise or axial movement to produce rotation thereof by stroking of the piston 20.

A suitable plastic plug 162 is provided receiving the electrical leads from the potentiometer terminals 161 and 182 in order to provide a hook up to external electrical connector pins 164 and 183. The plug 162 may advantageously be configured to receive an electrical connector for convenient connection and disconnection.

The drum element 144 is of a general type which is commercially available from the New England Instrument Company and other suppliers of conductive plastic potentiometers. As with the above-described embodiments, the conductive plastic elements are suitable for operation immersed in hydraulic oils and at the extremely high pressures and relatively elevated temperatures sometimes experienced in the interior of such hydraulic cylinders.

The wiper element 148 contacts the wiper track 163 and the active resistive track 165, both extending about the interior of the drum 144. Wiper track 163 provides for a suitable external wiper connection (via terminal 182 and pin 183), and either end of the active track 165 connected (via terminals 161 and pins 164) to opposite polarity voltage sources, in the manner well known in the art.

Figure 11:
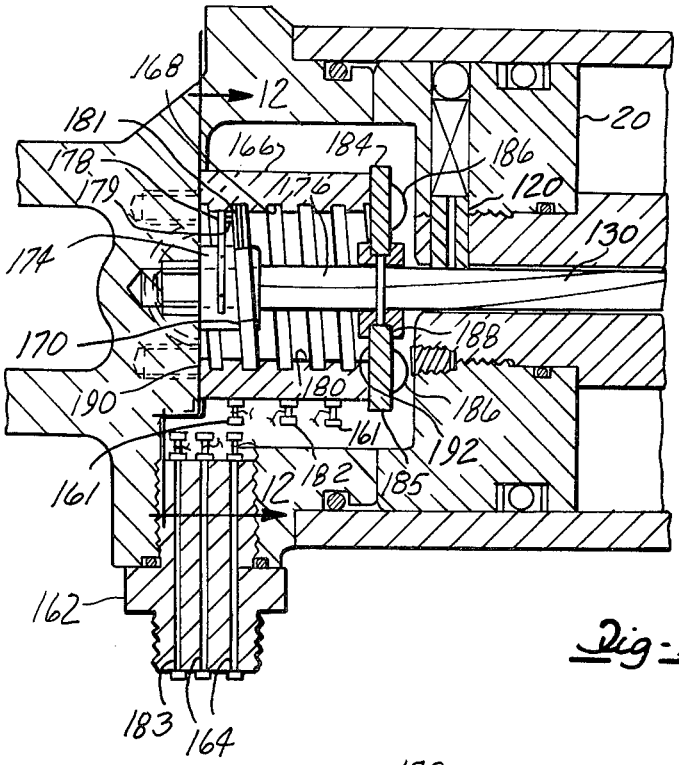
FIG. 11 is a fragmentary view in partial longitudinal section of a fluid pressure actuator with an internal indicator incorporating a multi-turn drum type potentiometer.
Figure 12:
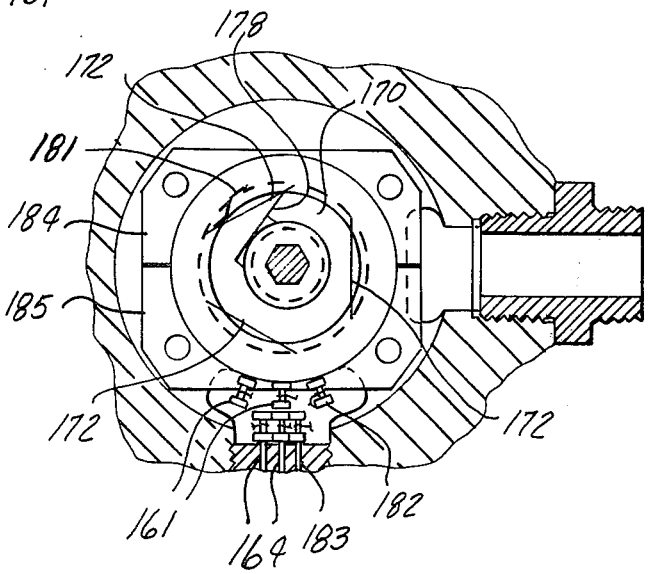
FIG. 12 is a view of the section 12—12 taken in FIG. 11.

A drum type potentiometer track element lends itself to the provision of a multi-turn potentiometer as depicted in FIGS. 11 and 12. In this arrangement, the potentiometer drum 166 is provided with an internal thread form 168 which is engaged by means of a tracking disc element 170 which may consist of a roughly triangularly shaped element as shown in FIGS. 11 and 12, having cut off sides 172 for the purpose of insuring hydraulic balance in the regions beneath the tracking element disc 170.

The tracking disc element 170 in turn is carried on a carrier element 174 which is adapted to be slidably moved on a hexagonal shaped end portion 176 formed in the cam rod 178. Thus, upon rotation of the cam rod 178 induced by stroking of the piston 20, the tracking element 170 is caused to be advanced by means of the engagement with the helical internal form 168. The carrier element 174 also carries a wiper element 178 which is engaged with the internal surface 180 intermediate the thread form 168 and provides a variable resistance at the end terminals 161 as in the above-described embodiments. The wiper connection may be via contact wiper 181 carried by the tracking disc element 170 extending to contact a conductive track at the root of the thread form 168 also connected to a terminal 182. A connector strip 179 electrically connects the wiper element 178 to the contact wiper 181.

Connector pins 164 and 183 carried by plug 162 are also provided for external circuit connections (not shown). Thus, upon stroking of the cylinder 20 and axial advance and retraction of the tracking disc element 170, an electrical signal may be generated corresponding to the relative position of the piston 20 in the cylinder sleeve 16.

In this instance, the drum 166 is maintained in position with retainer plates 184 and 185 secured by means of cap screws 186. A suitable retainer 188 is provided to provide the axial retention of the cam rod 178 to produce the rotation thereof upon stroking of the piston 20.

In this embodiment the spring biased plungers 120 are also provided to enable an overload release for setting of the end point positions of the multi-turn potentiometer, since upon carrier element 174 reaching the end wall 190 or face 192 of retainer 188, retraction of the plungers 120 will allow over-travel such that the end point of the potentiometer carrier 174 is easily set and inadvertent overdriving will not produce damage to the componentry.

Accordingly, it can be appreciated that the above-recited objects of the present invention have been achieved by the arrangement described inasmuch as an extremely simple and compact totally enclosed arrangement is provided by the rotary potentiometer and is adapted to be manufactured at a modest additional cost over the actuator unit itself.

The embodiments of the invention in which an exclusive property or privilege is claimed are defined as follows:

1. In combination with a fluid pressure actuator of the piston and cylinder type comprising a cylinder and a piston assembly including a piston slidably mounted within said cylinder, a pair of end caps closing off either end of said cylinder to thereby define a fluid pressure chamber adjacent to each end cap on either side of said piston assembly, each end cap having an end face abutting against said piston in respective extreme positions of said piston in said cylinder; one of said fluid pressure chambers including a cavity formed between said piston and one of said end caps with said piston in abutment thereagainst, pressure port means for selectively pressurizing said one of said fluid pressure chambers, said piston assembly further including a piston rod affixed to said piston and extending through the other of said end caps:

an indicating arrangement comprising: a bore formed into said piston assembly extending axially away from said one end cap, a cam rod having one end slidably fit into said bore formed into said piston assembly, said cam rod other end extending axially away from said piston assembly towards said one end cap;

means axially fixing said cam rod element with respect to said cylinder whereby causing said one end of said cam rod to be reciprocated within said bore upon reciprocal stroking of said piston assembly in said cylinder;

at least one camming element carried by said piston assembly in engagement with a surface of said cam rod element causing rotation of said cam rod upon reciprocation of said piston assembly in said cylinder;

rotary potentiometer means mounted within said cavity including a rotary wiper element;

electrical connection means connected to said rotary potentiometer means and means providing a variable resistance in correspondence with the rotary position of said rotary wiper element;

means drivingly connecting the other end of said cam rod and said rotary potentiometer wiper element producing corresponding rotation of said rotary wiper element upon rotation of said cam rod, whereby an electrical signal corresponding to the position of said piston assembly in said cylinder may be generated by said rotary potentiometer means.

2. The fluid pressure actuator according to claim 1 wherein said rotary potentiometer means includes a track element having at least one conductive plastic resistive track formed thereon.

3. The fluid pressure actuator according to claim 1 wherein said cam rod comprises a spirally twisted rod, and wherein said at least one camming element comprises a cam bushing formed with an angularly shaped bore and wherein said cam rod is formed with a complementary shape passing therethrough said shape preventing relative rotation therebetween.

4. The fluid pressure actuator according to claim 1 wherein said means drivingly connecting said cam rod and said potentiometer wiper element comprise a coupling member affixed to said cam rod connected to rotate together therewith, and wherein said spirally twisted rod is formed with less than a 360° twist along its length.

5. The fluid pressure actuator according to claim 1 wherein said means drivingly connecting said potentiometer wiper element and said cam rod comprises gearing means interposed between said cam rod and said rotary wiper element, said means providing a reduced rate of rotation of said wiper element in response to rotation of said cam rod.

6. The fluid pressure actuator according to claim 5 wherein said gearing means comprises a gear reduction spur gearing including a spur gear affixed to said cam rod element and a second spur gear in mesh with said cam rod element spur gear and also including a shaft having said second spur gear affixed thereto and to said wiper element.

7. The fluid pressure actuator according to claim 5 wherein said gearing means comprises a planetary gearing means aligned with the axis of said cam rod, further including a sun gear affixed to said cam rod with a plurality of planetary gears arranged about said sun gear in mesh therewith, a planetary carrier supporting said plurality of planetary gears and a ring gear affixed to one of said end caps of said fluid pressure actuator, said planetary gears also in mesh with said ring gear; and, further including means affixing said wiper element to said planetary carrier to produce a reduced rotational rate thereof with respect to said cam rod.

8. The fluid pressure actuator according to claim 5 wherein said cam rod comprises a multi-turn spiral and further including positive stop means limiting the stroke of said piston in either direction of said movement within said cylinder; and wherein during said stroking motion of said piston and cylinder, said cam rod is rotated a plurality of revolutions and wherein said gearing means reduces said rotation of said cam rod to less than a single revolution of said wiper element.

9. In combination with a fluid pressure actuator of the piston and cylinder type comprising a cylinder and a piston assembly including a piston slidably mounted within said cylinder, a pair of end caps closing off either end of said cylinder to thereby define a fluid pressure chamber adjacent to each end cap on either side of said piston assembly, each end cap having an end face abutting against said piston in respective extreme positions of said piston in said cylinder; one of said fluid pressure chambers including a cavity formed between said piston and one of said end caps with said piston in abutment thereagainst, pressure port means for selectively pressurizing said one of said fluid pressure chambers, said piston assembly further including a piston rod affixed to said piston and extending through the other of said end caps;

an indicator arrangement comprising: a bore formed into said piston assembly extending axially away from said one end cap, a cam rod having one end slidably fit into said bore formed into said piston assembly, said cam rod other end extending axially away from said piston assembly towards said one end cap;

means axially fixing said cam rod element with respect to said cylinder whereby causing said one end of said cam rod to be reciprocated within said bore upon reciprocal stroking of said piston assembly in said cylinder;

a plurality of radially converging plungers carried by said piston assembly and means biasing each of said plungers into engagement with a surface of said cam rod element causing rotation of said cam rod upon reciprocation of said piston assembly in said cylinder;

rotary potentiometer means mounted within said cavity including a rotary wiper element;

electrical connection means connected to said rotary potentiometer means and means providing a variable resistance in correspondence with the rotary position of said rotary wiper element;

means drivingly connecting the other end of said cam rod and said rotary potentiometer wiper element producing corresponding rotation of said rotary wiper element upon rotation of said cam rod, whereby an electrical signal corresponding to the position of said piston assembly in said cylinder may be generated by said rotary potentiometer means.

10. The fluid pressure actuator according to claim 9 wherein said cam rod is formed with a plurality of flat sides, and wherein each of said plungers is biased into engagement with a respective one of said plurality of flat sides.

11. The fluid pressure actuator according to claim 9 wherein each of said plungers is slidably disposed in a bore formed in said piston.

12. The fluid pressure actuator according to claim 11 wherein said means biasing each of said plungers into engagement with said cam rod comprises a compression spring disposed in each of said bores.

13. The fluid pressure actuator according to claim 10 wherein said cam rod comprises a spirally twisted hexagonal shaped rod.

14. In combination with a fluid pressure actuator of the piston and cylinder type comprising a cylinder and a piston assembly including a piston slidably mounted within said cylinder, a pair of end caps closing off either end of said cylinder to thereby define a fluid pressure chamber adjacent to each end cap on either side of said piston assembly, each end cap having an end face abutting against said piston in respective extreme positions of said piston in said cylinder; one of said fluid pressure chambers including a cavity formed between said piston and one of said end caps with said piston in abutment thereagainst, pressure port means for selectively pressurizing said one of said fluid pressure chambers, said piston assembly further including a piston rod affixed to said piston and extending through the other of said end caps;

an indicator arrangement comprising: a bore formed into said piston assembly extending axially away from said one end cap, a cam rod having one end slidably fit into said bore formed into said piston assembly, said cam rod other end extending axially away from said piston assembly towards said one end cap;

means axially fixing said cam rod element with respect to said cylinder whereby causing said one end of said cam rod to be reciprocated within said bore upon reciprocal stroking of said piston assembly in said cylinder;

at least one camming element carried by said piston assembly in engagement with a surface of said cam rod element causing rotation of said cam rod upon reciprocation of said piston assembly in said cylinder;

rotary potentiometer means mounted within said cavity including a rotary wiper element;

electrical connection means connected to said rotary potentiometer means and means providing a variable resistance in correspondence with the rotary position of said rotary wiper element, said rotary potentiometer means including a drum mounted with its axis in alignment with said cam rod and wherein said cam rod extends through said drum and is received in a bore formed into said other of said end caps;

means drivingly connecting the other end of said cam rod and said rotary potentiometer wiper element producing corresponding rotation of said rotary wiper element upon rotation of said cam rod, whereby an electrical signal corresponding to the position of said piston assembly in said cylinder may be generated by said rotary potentiometer means.

15. The fluid pressure actuator according to claim 14 wherein said rotary potentiometer wiper element extends into wiping engagement with the interior surface of said drum.

16. The fluid pressure actuator according to claim 15 wherein said rotary potentiometer drum is formed with a conductive spiral track and wherein said wiper element is mounted to be advanced axially upon rotation of said cam rod while maintaining engagement with said spiral track, whereby a multi-turn potentiometer is provided.

17. The fluid pressure actuator according to claim 16 wherein said wiper element is carried by a carrier element slidably mounted on said cam rod end portion, and wherein said drum is formed with a helical track engaged by said carrier element to cause said axial advance of said wiper element upon rotation of said cam rod.

* * * * *